US011933036B2

(12) United States Patent
Naylor et al.

(10) Patent No.: US 11,933,036 B2
(45) Date of Patent: Mar. 19, 2024

(54) WALL SECTION FORMED OF FOLDED SHEET METAL

(71) Applicant: Bok Modern LLC, San Rafael, CA (US)

(72) Inventors: Russell Naylor, San Francisco, CA (US); Hearee S. Chu, San Francisco, CA (US)

(73) Assignee: Bok Modern LLC, San Rafael, CA (US)

( * ) Notice: Subject to any disclaimer, the term of this patent is extended or adjusted under 35 U.S.C. 154(b) by 0 days.

(21) Appl. No.: 17/336,007

(22) Filed: Jun. 1, 2021

(65) Prior Publication Data

US 2021/0372124 A1 Dec. 2, 2021

Related U.S. Application Data

(60) Provisional application No. 63/032,433, filed on May 29, 2020.

(51) Int. Cl.

| | |
|---|---|
| ***E04B 1/343*** | (2006.01) |
| ***E04B 1/08*** | (2006.01) |
| ***E04B 2/00*** | (2006.01) |
| ***E04B 2/74*** | (2006.01) |
| ***E04B 7/02*** | (2006.01) |
| ***E04C 2/08*** | (2006.01) |
| ***E04C 2/34*** | (2006.01) |
| *E04D 13/072* | (2006.01) |

(52) U.S. Cl.

CPC ..... *E04B 1/34321* (2013.01); *E04B 1/08* (2013.01); *E04B 2/7401* (2013.01); *E04B 7/026* (2013.01); *E04C 2/08* (2013.01); *E04C 2/34* (2013.01); *E04C 2/46* (2013.01); *E04C 2002/3488* (2013.01); *E04D 13/0727* (2013.01)

(58) Field of Classification Search

CPC ..... E04B 1/08; E04B 1/34321; E04B 2/7401; E04B 7/026; E04C 2/08; E04C 2/34; E04C 2/46; E04C 2/384; E04C 2002/3488; E04D 13/0727; E04D 13/064

See application file for complete search history.

(56) References Cited

U.S. PATENT DOCUMENTS 217,132 A * 7/1879 McNish ..... B41B 1/28 276/40
1,726,500 A * 8/1929 Norris ..... E04B 9/26 52/762

(Continued)

FOREIGN PATENT DOCUMENTS

DE 20307574 U1 * 8/2003 ..... A47B 96/18
FR 2546606 A1 * 11/1984

(Continued)

*Primary Examiner* — Jessie T Fonseca

(74) *Attorney, Agent, or Firm* — Brian Beverly; Beeson Skinner Beverly, LLP

(57) ABSTRACT

A wall section formed from sheet metal has a main panel, opposing vertical side flanges extending rearwardly from the side edges of the main panel, top and bottom horizontal flanges extending rearwardly from the panel, and stiffening flanges extending perpendicularly from the rear edges of the side, top and bottom flanges, thereby forming load bearing side beams, a header and a sill plate, the side flanges for attachment to the those of abutting wall sections to form a wall.

13 Claims, 12 Drawing Sheets

(56) References Cited

U.S. PATENT DOCUMENTS 1,943,777 A * 1/1934 Wallace ..... E06B 9/52 403/42
2,818,946 A * 1/1958 Noel ..... B60J 5/0488 49/501
3,143,988 A * 8/1964 Reardon ..... B21D 51/2646 72/356
RE30,108 E * 10/1979 Oliver ..... E04C 2/384 52/192
4,344,267 A * 8/1982 Sukolics ..... E04B 1/617 52/510
4,452,029 A * 6/1984 Sukolics ..... E04B 1/617 52/510
4,603,532 A * 8/1986 Watson ..... E04B 5/10 52/262
4,829,740 A * 5/1989 Hutchison ..... E04F 19/06 52/475.1
6,745,527 B1 * 6/2004 Sherman ..... E06B 3/5427 52/235
8,166,716 B2 * 5/2012 Macdonald ..... E04F 13/12 52/235
8,739,483 B1 * 6/2014 Bilge ..... E04F 13/0858 52/235
9,328,517 B2 * 5/2016 Bilge ..... E04F 13/0889
9,850,666 B2 * 12/2017 Libreiro ..... E04F 13/0816
2004/0134143 A1 * 7/2004 Boyer ..... E04F 13/0878 52/235

FOREIGN PATENT DOCUMENTS

GB 2339440 A * 1/2000 ..... E04B 1/6145
WO WO-0020698 A1 * 4/2000 ..... E04B 1/08
WO WO-2014177768 A1 * 11/2014 ..... B23K 11/08

* cited by examiner

WALL SECTION FORMED OF FOLDED SHEET METAL

CROSS-REFERENCE TO RELATED APPLICATIONS

This application claims the benefit of U.S. Provisional Application No. 63/032,433 filed May 29, 2020 and which is fully incorporated herein by reference.

BACKGROUND

Technical Field

This invention is directed to construction of buildings and particularly to construction of wall sections formed from sheet metal for forming parts of a wall capable of carrying the loads of a structure designed for housing human activity or for a free-standing wall.

Description of Related Art

Loads generated by medium and large buildings mandate the use of very strong structural materials such as structural steel—most commonly I-beams—and concrete, in myriad combinations. While tremendously strong, these materials are expensive and heavy, and require heavy equipment and skilled labor to transport and install in a building.

Load demands are not as large in residences and smaller commercial buildings, such as warehouses and factory buildings having a limited height, so that it is desirable to avoid the high cost of using unnecessarily strong structural materials if possible. Wood is therefore commonly used as, for example, beams, posts, header, shear walls, and diagonal bracing for such smaller buildings. While wood is efficient, it is impermanent as being subject to rot, mildew, insects and other destructive forces. Wood is also relatively weak compared to metal and needs to be strengthened with shear walls, metal hold-down fittings and clips at increased material and labor costs. Accordingly, it would be an advantage if structural elements were available that were suited to carrying the loads in smaller buildings and that were stronger and simpler to install than wood.

Non-load bearing structural elements in buildings of all sizes may include building facades, water-shedding surfaces, balcony walls, space dividers and aesthetic elements. These secondary structural elements must still be firmly affixed to the load-bearing parts of the structure, which is traditionally accomplished using nails, screws, bolts, proprietary connectors, hold-downs, hurricane clips, and other fasteners, but construction costs could be reduced significantly if it were possible to decrease the use of such traditional fasteners.

SUMMARY OF THE INVENTION

The invention is directed to structural elements formed from sheet metal in which structural strength is created and integrated into the sheet metal by folding it. In one embodiment of the invention a wall section is formed from sheet metal to form a wall having load-bearing properties capable of supporting the other structural elements of low-rise buildings intended for human habitability, such as living quarters, warehouses, shops and manufacturing facilities.

DETAILED DESCRIPTION OF THE ILLUSTRATED EMBODIMENT

Figure 1A:
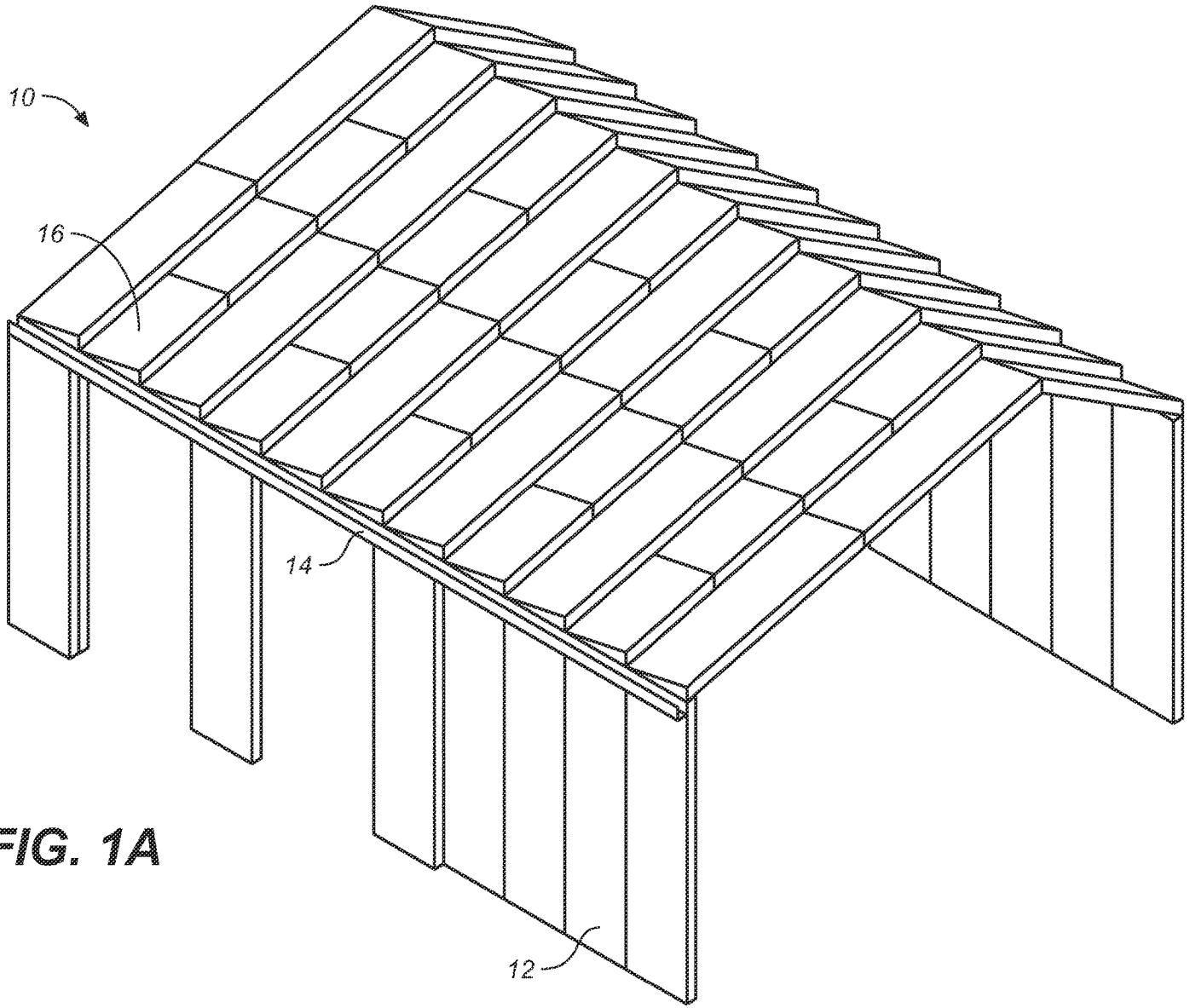
FIG. 1A is a perspective view of a building formed from folded sheet metal panels according to the invention.
Figure 1B:
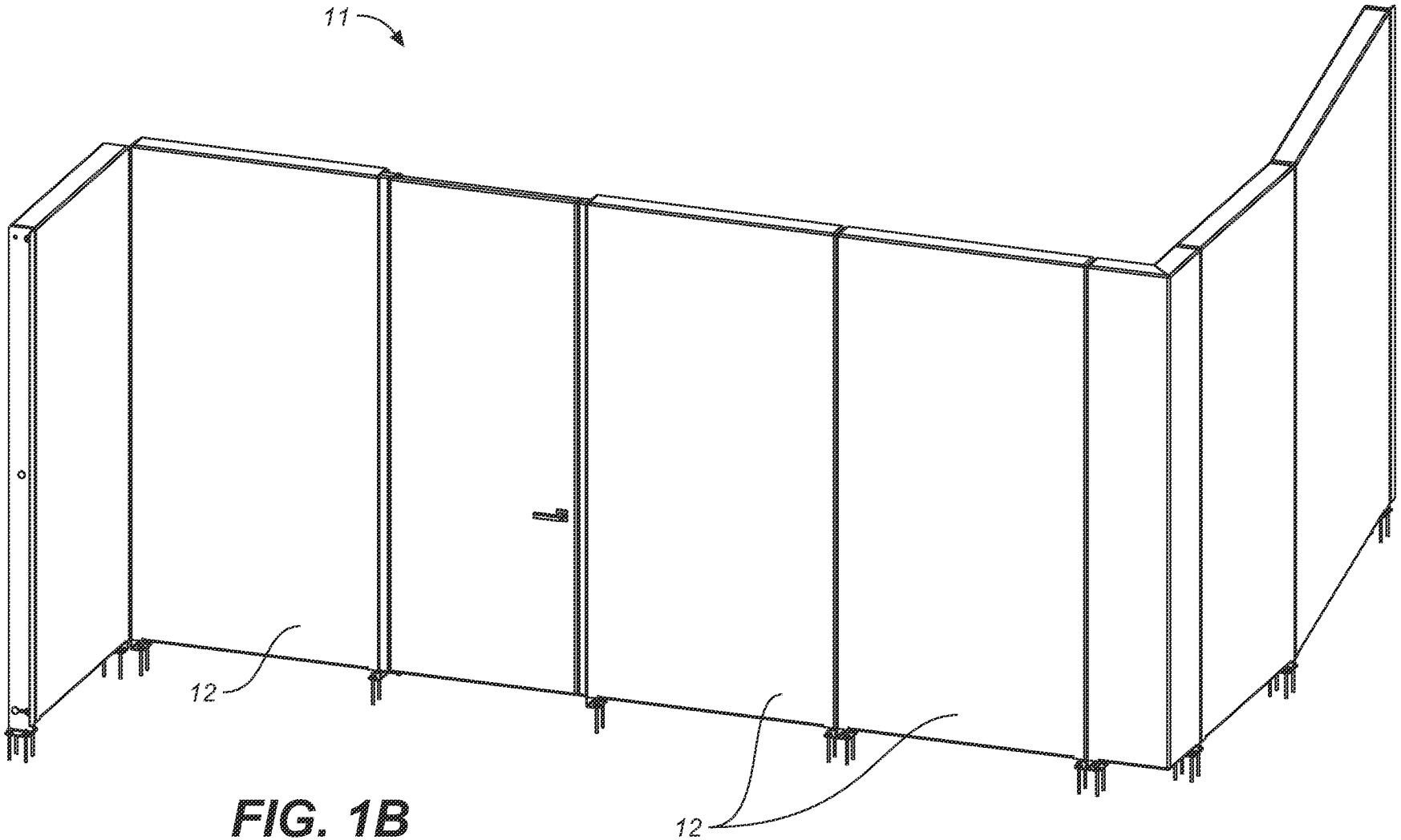
FIG. 1B is a perspective view of a free-standing wall formed from folded sheet metal panels according to the invention.

A building formed from folded sheet metal elements, indicated generally at 10 in FIG. 1A, comprises wall sections 12, gutter panels 14 and roof panels 16. In another implementation of the invention, wall sections 12 may be joined together in an assembled configuration to form a free-standing wall 11 as shown in FIG. 1B. With added reference to FIGS. 2A and 2B, each wall section 12 comprises a main panel 18 having front and back faces 18F, 18B. Opposite side flanges 20 and top and bottom flanges 22, 24 extend rearwardly from and generally perpendicular to the main panel 18. In the embodiment shown in FIG. 2B, side, top and bottom stiffening flanges 26, 28 and 30 extend inwardly from the side, top and bottom flanges 20, 22, 24, respectively. The corners formed by the side, top and bottom flanges, 20, 22, 24 and the main panel 18 strengthen the vertical edges of the panel effectively forming vertical load-carrying side beams at 18-20, a top plate at 18-22 and a sill plate at 18-24. The corners formed by the stiffening flanges 26, 28, 30 and the side, top and bottom flanges, 20, 22, 24 further stiffen the edges of the panel and allow the wall sections 12 to support loads generated by the gutter and roof panels 14, 16.

A wall section formed from folded sheet metal according to the invention can be constructed from aluminum, carbon steel or stainless steel of a gauge between 8 and 14 and, if aluminum, between ⅛" to ¼" thick, as suitable for supporting the loads imposed by a particular structure. Each wall section 12 is formed from a single blank of sheet metal and the flanges are formed by folding the sheet metal.

Figure 2A:
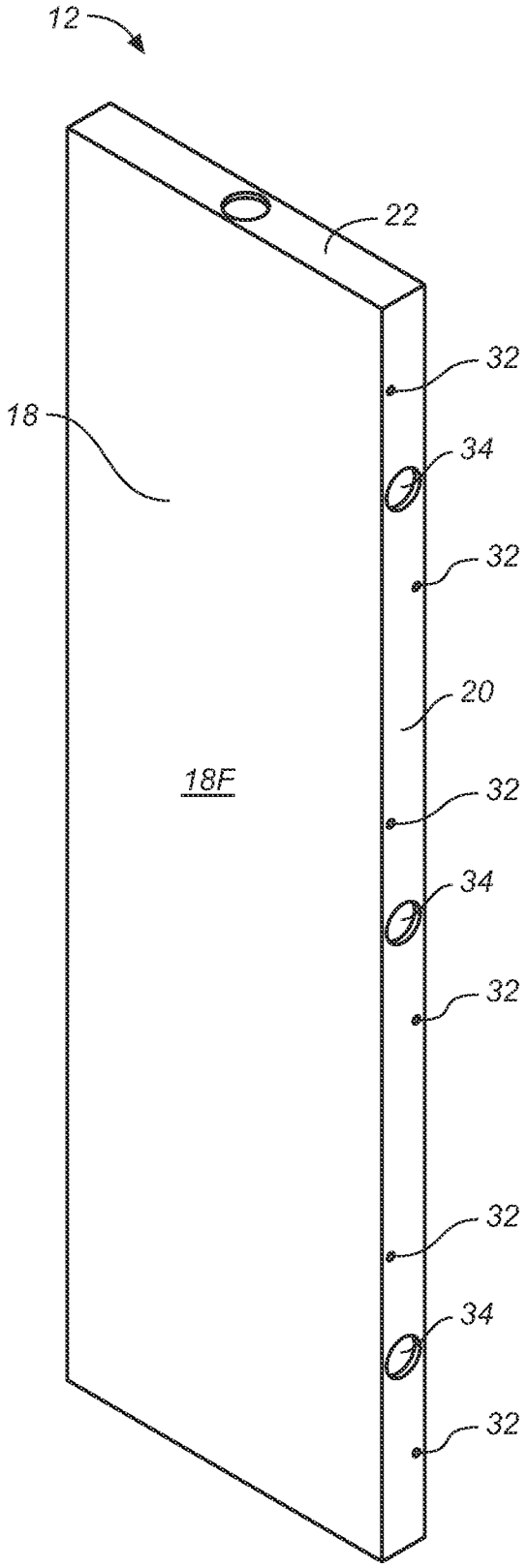
FIGS. 2A and 2B are front and back perspective views of a wall section formed from sheet metal according to the invention.
Figure 2B:
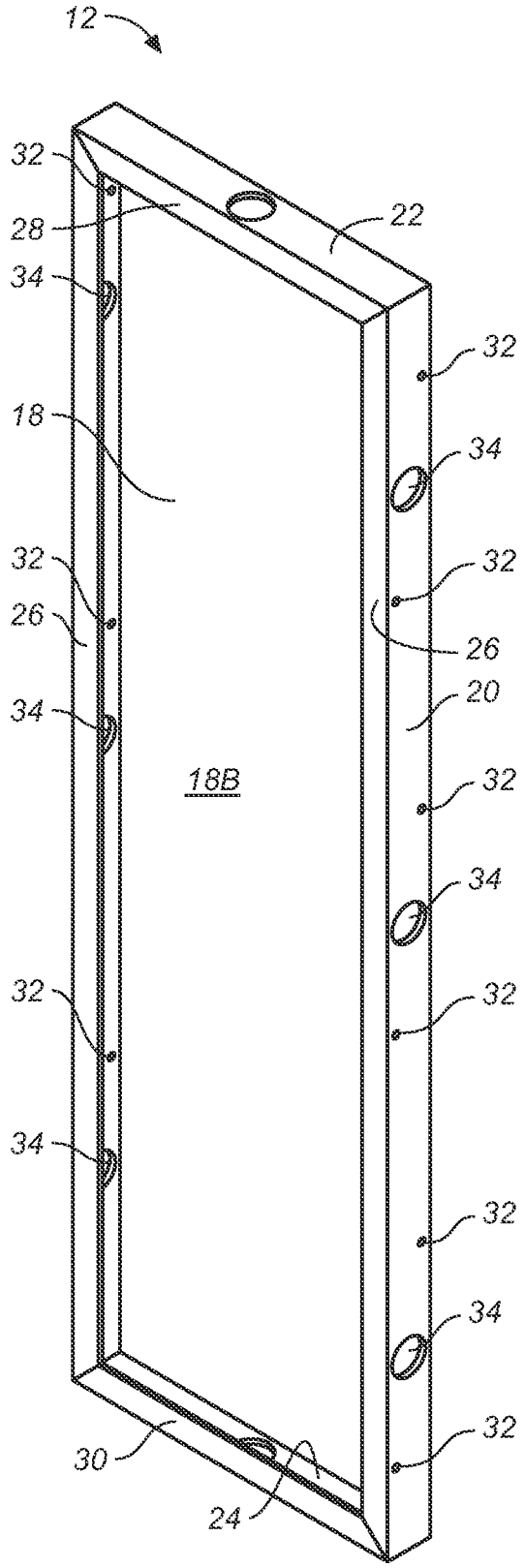
Figure 2C:
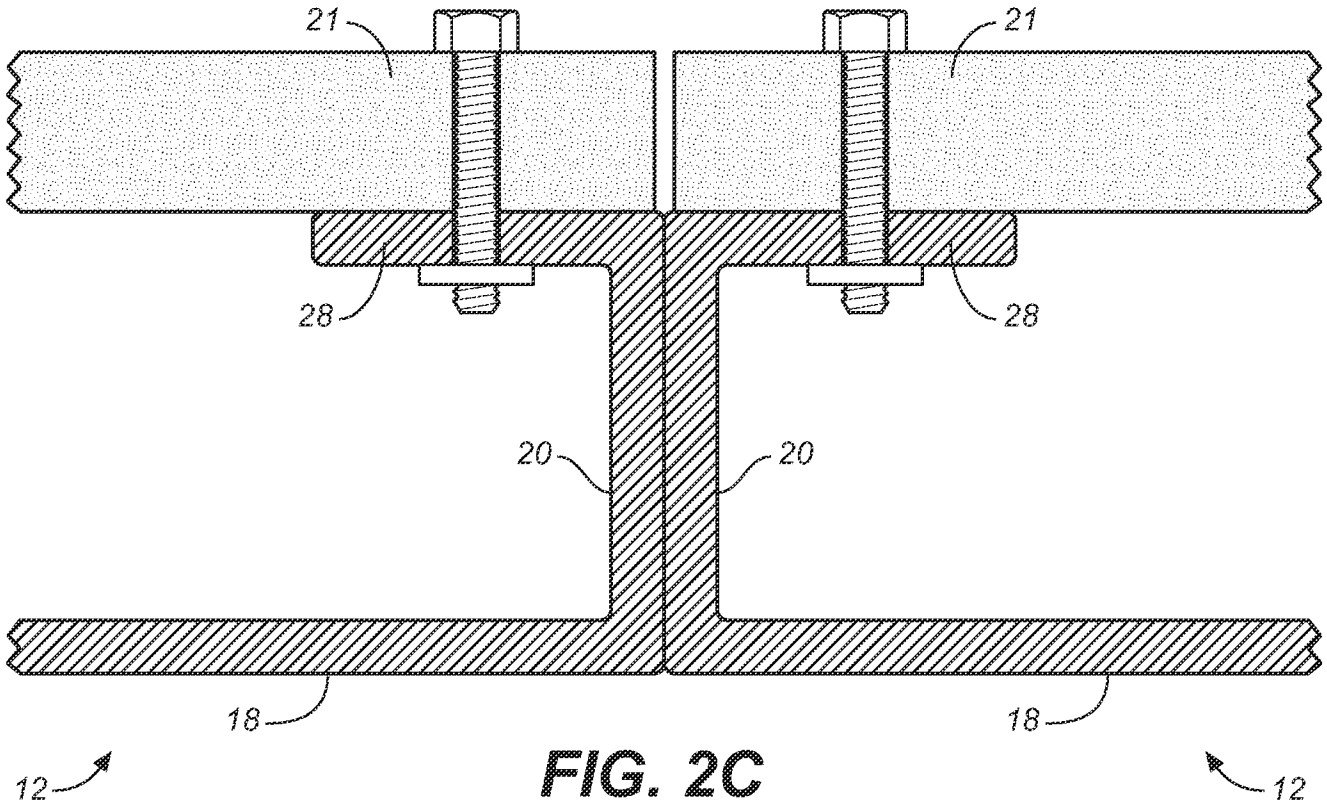
FIG. 2C is a close up sectional view of the sides of two abutted wall sections according to the invention.

With continuing reference to FIGS. 2A and 2B, it is seen that the side flanges 20 include fastener holes 32 arranged so that the fastener holes in one of the side flanges 20 align with the fastener holes of the opposite side flange 20 of an adjacent wall section to facilitate attachment together of multiple abutting wall sections. Larger openings 34 are also provided in the side, top and bottom flanges 20, 22, 24 to accommodate electrical and plumbing utilities. The abutting side flanges 20 of two wall sections are seen in FIG. 2C supporting interior wall covering 21.

Figure 3:
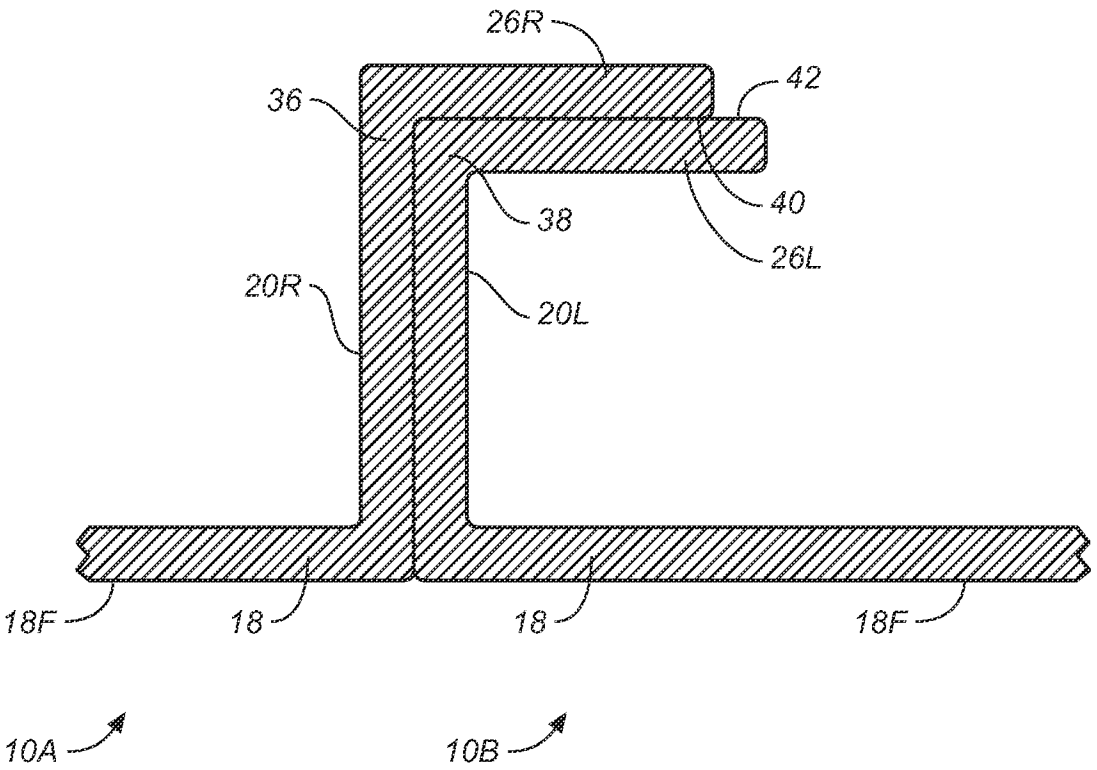
FIG. 3 is a close-up sectional view of nested flanges corners of two adjacent wall sections according to the invention.

With reference to FIG. 3, in one embodiment of the invention, the right side stiffening flange 26R of the right side flange 20R of a first wall section 10A is bent outwardly as shown forming an outside corner 36, and the left side stiffening flange 26L of the left side flange 20L of an adjacent second wall section 10B is bent inwardly forming an inside corner 38. As shown, the distance between the front surface 18F of the main panel 18 to the forward-facing surface 40 of the outwardly-extending stiffening flange 26R of the first wall section 10A is equivalent to the distance between the front surface 18F of the main panel 18 and the rear-facing surface 42 of the inwardly-extending stiffening flange 26L of the second wall section 10B, such that the inner corner 38 of the second wall section (on the right) nests in the outer corner 36 of the first wall section (on the left) and aligns the front surfaces 18F of the main panels 18 thereof.

Figure 4A:
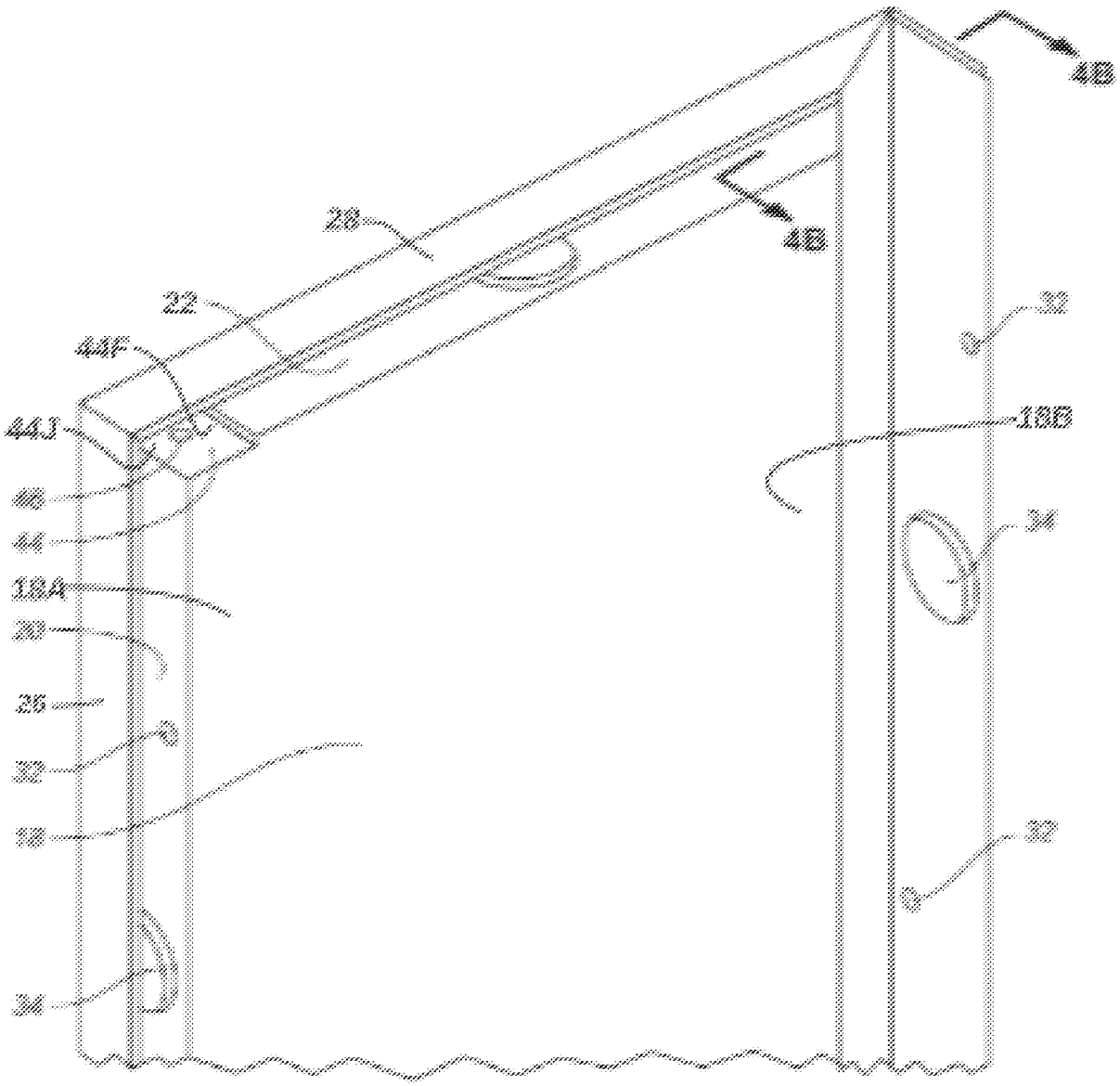
FIG. 4A is a lower perspective view of a double fold corner of a wall section according to the invention.
Figure 4B:
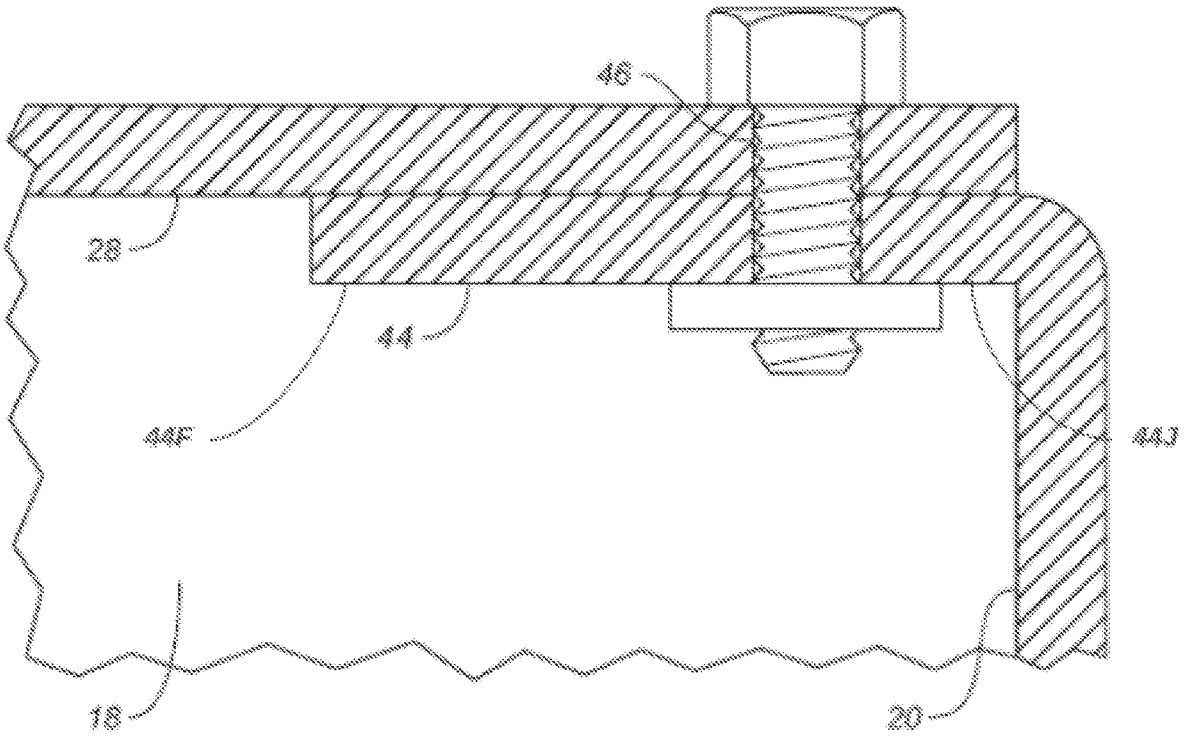
FIG. 4B is a sectional view of the double fold corner of the wall section shown in FIG. 4A

With reference now to FIGS. 4A and 48, a double-fold corner is described. In the illustrated embodiment, the top end of one of the side flanges 20 is folded inwardly at a joint edge 44J from one side edge 18A of the main panel 18 toward the other side edge 188 thereof to form a corner tab 44 having a free end 44F closer to the other side than the joint edge 44J. Each corner tab 44 has a similar configuration in which the free end is closer to the other side of the main panel than the joint edge. The corner tab 44 in the illustrated embodiment is overlapped and covered by top flange 22 so that it is hidden from view between main panel 18 and side and top stiffening flanges 26, 28. A fastening hole 46 may be provided in corner tab 44 and a cooperating fastening hole 48 may be provided in overlapping top flange 22 to accommodate fasteners to tie the tab 44 and top flange 22 together, thereby forming a double-fold corner. The double-fold corner according to the invention greatly strengthens the corner joint formed by the main panel 18, the top flange 22 and the side flange 20 facilitating the transfer of loads experienced at the corner down to a foundation to which the panel is secured without the need for welding the top and side flanges together. It will be readily appreciated that a similar configuration can be implemented on all four corners of the wall section.

Figure 5:
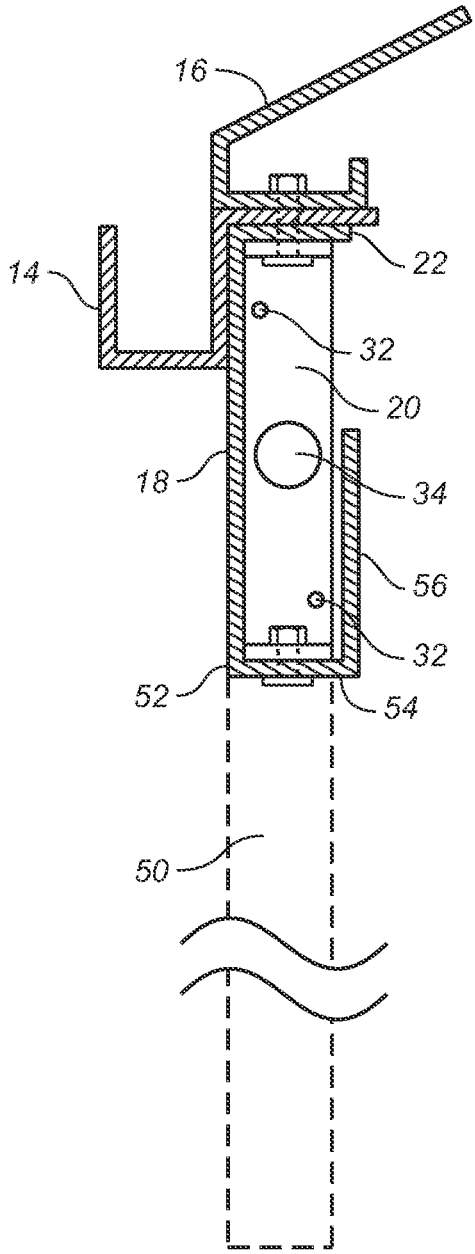
FIG. 5 is a side sectional view of a partial height wall section cut and folded to form an opening below it.
Figure 6:
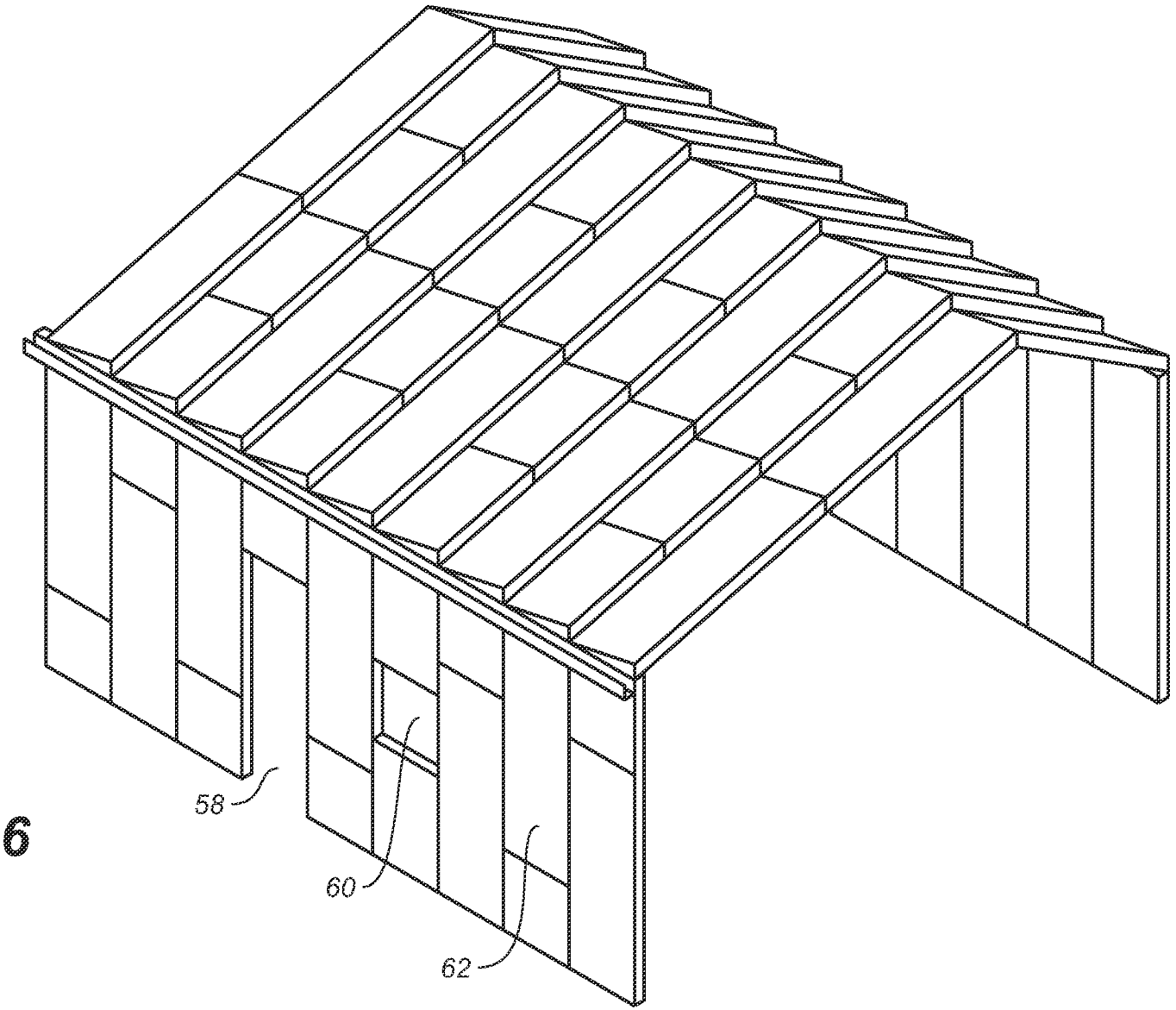
FIG. 6 is a perspective view of another embodiment of a building formed from folded sheet metal panels.

Referring to FIG. 5, in some embodiments of the invention, openings 50 for doors and windows can be formed in wall sections by cutting the main panel horizontally and folding along an upper edge 52 to create an upper flange 54 the end portion of which in turn may be folded upward to form an upper stiffening flange 56 to create, e.g., a door opening 58 as shown in FIG. 6. The main panel 18, upper flange 54 and upper stiffening flange 56 form a header defining the upper edge of the opening 50. In like manner a window sill can be formed, and the side edges formed independently, to create a window opening 60.

Figure 7:
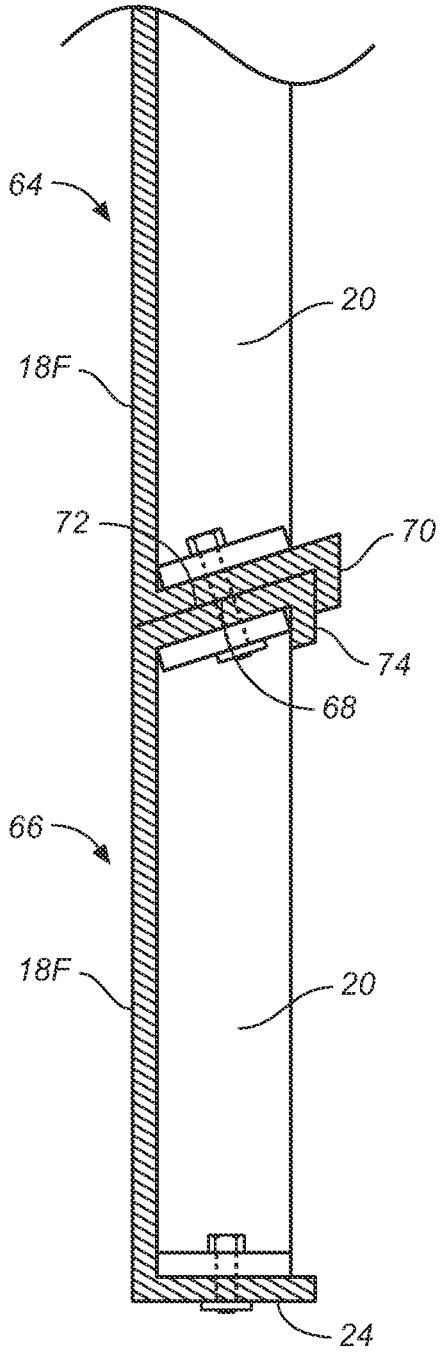
FIG. 7 is a side sectional elevation view of a part of a wall formed from multiple wall sections according to the invention.

In another embodiment of the invention, a plurality of wall sections are used to form part of a wall to a desired height as seen at 62 in FIG. 6. In the embodiment shown in FIG. 7, a top wall section 64 and a bottom wall section 66 are combined to form a wall of the desired height. As seen the bottom flange 68 of the top wall section 64 is folded at an acute angle relative to the front face 18F thereof and the stiffening flange 70 extending from the bottom flange 68 is folded downwardly from the rear edge thereof, whereas the top flange 72 of the bottom wall section 66 is folded at an obtuse angle relative to the front face 18F thereof and the stiffening flange 74 extending from the rear edge of the top flange 72 is folded downwardly. The obtuse and acute angles correspond as seen so that the top and stiffening flanges 72, 74 of the bottom section 66 nest in the corner formed by the bottom and stiffening flanges 68, 70 of the top wall section 64, thereby aligning the front faces 18F of the wall sections and forming a drip space so that so that moisture present between the top and bottom wall sections drains toward the front faces 18F of the main panels thereof.

Figure 8:
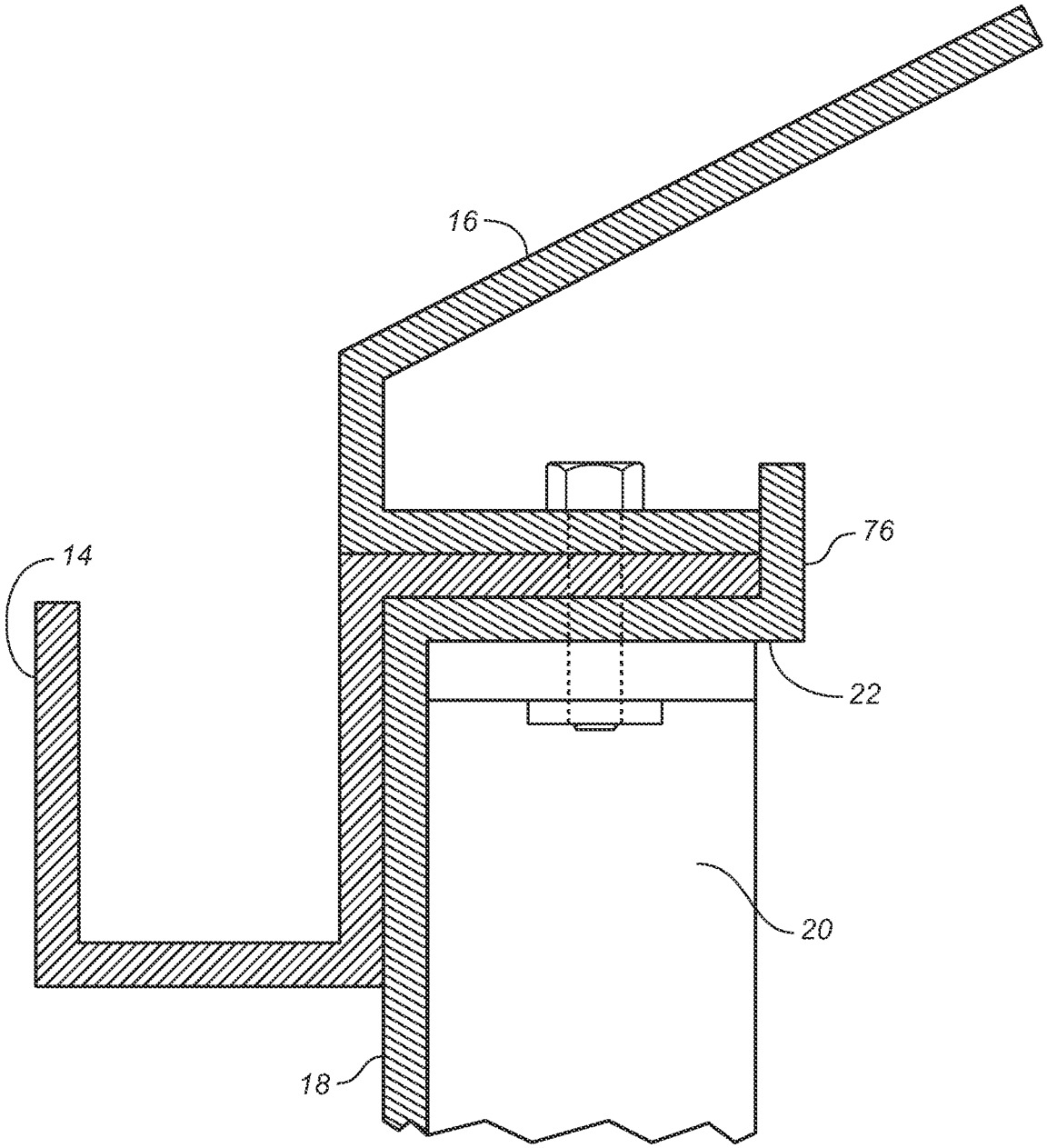
FIG. 8 is a side sectional elevation view of another embodiment of the invention.

In another embodiment of the invention seen in FIG. 8, stiffening flange 76 extends upwardly from the top flange 20 to create a backstop for gutter and roof panels 14, 16. This configuration also ensures that any moisture trapped between the gutter or roof panels 14, 16 or between the gutter panel 14 and the top flange 20 is directed outwardly toward the exterior of the wall.

As discussed above, each wall section 12 is created by folding structural elements directly into a metal sheet thus eliminating the need for many secondary posts and other structural members. The panels can be either solid or laser cut with an infinite variety of patterns and typically does not require welding. Installation is quick and easy relative to prior art wall construction because each wall section is merely tilted up in place and bolted down to pre-installed bolts in a concrete footing.

There have thus been described and illustrated certain embodiments of a wall section formed from sheet metal according to the invention. Although the present invention has been described and illustrated in detail, it should be clearly understood that the disclosure is illustrative only and is not to be taken as limiting, the spirit and scope of the invention being limited only by the terms of the appended claims and their legal equivalents.

We claim:

1. A wall section assembly for forming part or all of a wall capable of carrying the loads of a structure designed for housing human activity, the wall section assembly comprising:

two or more wall sections, each wall section comprising:

a main panel having a front surface, two side flanges disposed perpendicularly to and extending rearwardly from the main panel, said side flanges for attachment to the side flanges of another of said two or more wall sections, an outwardly-extending stiffening flange extending outwardly from one of said two side flanges forming an outer corner, the outwardly-extending stiffening flange having a forward-facing surface, an inwardly-extending stiffening flange extending inwardly from the other of said two side flanges forming an inner corner, the inwardly-extending stiffening flange having an rear-facing surface, the distance between the front surface of the main panel to the forward-facing surface of the outwardly-extending stiffening flange equivalent to the distance between the front surface of the main panel and the rear-facing surface of the inwardly-extending stiffening panel, and top and bottom flanges in parallel alignment with and extending rearwardly from the main panel, the main panel and the side, top, bottom, and stiffening flanges formed by folding a sheet metal blank, such that the inner corner of a first one of said two or more wall sections nests in the outer corner of a second one of said two or more wall sections disposed in abutting relation to the first one of said wall sections and aligns the front surfaces of the main panels of said first and second wall sections.

2. The wall section of claim 1 further comprising:

a top stiffening flange extending upwardly from the top flange parallel to the main panel, the top stiffening flange formed by folding the sheet metal blank relative to the top flange.

3. The wall section of claim 1 further comprising:

the blank formed from sheet metal having a metal gauge between 10 and 14 as suitable for the loads imposed by the structure.

4. The wall section of claim 3 further comprising:

the blank comprising aluminum having a thickness of ⅛ to ¼ inches.

5. The wall section of claim 1 further comprising:

the blank formed from the group consisting of aluminum, carbon steel and stainless steel.

6. The wall section of claim 1 further comprising:

said two side flanges each including one or more fastener bores for accommodating fasteners to attach said side flanges to those of another wall section of said two or more wall sections.

7. A wall section assembly for forming part or all of a wall capable of carrying the loads of a structure designed for housing human activity, the wall section assembly comprising:

top and bottom wall sections each having main panels disposed in a common vertical plane, the main panels having front faces, the bottom wall section supporting the top wall section, the top wall section having a bottom flange, the bottom wall section including a top flange having a rear edge, the bottom flange of the top wall section disposed at an acute angle relative to the front face of the main panel thereof, a stiffening flange extending downwardly from a rear edge of said bottom flange forming an acute downwardly opening angle relative to the bottom flange, the top flange of the bottom wall section disposed at an obtuse angle relative to the front face of the main panel of the bottom wall section, a stiffening flange extending downwardly from the rear edge of said top flange forming an acute angle relative to the top flange of the bottom wall section corresponding to the acute angle of the top wall section, such that the top and stiffening flanges of the bottom wall section nest in the bottom and stiffening flanges of the top wall section, so that the bottom wall section supports the top wall section with the front faces of the main panels of the top and bottom wall sections in coplanar disposition, and so that moisture present between the top and bottom wall sections drains toward the front faces of the main panels thereof.

8. A wall section comprising:

a main panel having two opposite side edges, top and bottom flanges extending rearwardly from the main panel, each of the top and bottom flanges having top and bottom surfaces, one or more side flanges extending rearwardly from the main panel, each of the one or more side flanges disposed at one of the side edges of the main panel, the one or more side flanges for attachment to side flanges of another wall section, each of the one or more side flanges having top and bottom ends, and one or more load-transferring corner tabs disposed at one or both of the top and bottom ends of said one or more side flanges, each of the one or more load-transferring corner tabs having upper and lower surfaces, a joint end, and a free end, each of said one or more corner tabs extending from one of the side edges of said main panel toward the opposite side edge thereof, one of the upper and lower surfaces of each of the one or more load-transferring corner tabs overlapping and attached to one of the top and bottom surfaces of one of the top and bottom flanges thereby forming a double-folded corner configuration, the main panel, the side, top and bottom flanges, and the one or more corner tabs being formed by folding a sheet metal blank, the wall section forming part of and being capable of carrying the loads of a building structure designed for human habitability, wherein the double-folded corner configuration, in cooperation with the one of the top and bottom flanges and the one or more side flanges, helps transfer loads experienced by the wall section to an underlying foundation.

9. The wall section of claim 8 further comprising:

the top and bottom flanges having interior surfaces, the corner tabs being attached to the interior surfaces of the top and bottom flanges.

10. The wall section of claim 8 further comprising:

said one or more side flanges comprising two side flanges in parallel alignment.

11. The wall section of claim 8 further comprising:

the blank comprising aluminum having a thickness of ⅛ to ¼ inches.

12. The wall section of claim 8 further comprising:

the one or more load-transferring corner tabs comprising two or more load-transferring corner tabs including one or more load-transferring top corner tabs and one or more load-transferring bottom corner tabs, the top flange overlapping and abutting the upper surfaces of the one or more load-transferring top corner tabs thereby forming double-folded corner configurations, and the bottom flange underlying and abutting the lower surfaces of the one or more load-transferring bottom corner tabs thereby forming double-folded corner configurations.

13. A wall section assembly comprising:

two or more wall sections, each wall section comprising:

a main panel, opposing side flanges extending rearwardly from and perpendicular to the main panel, the side flanges in parallel alignment, top and bottom flanges extending rearwardly from and perpendicular to the main panel, each of the top and bottom flanges having top and bottom surfaces, stiffening flanges extending from the side flanges parallel to the main panel, each of the stiffening flanges having top and bottom ends, the stiffening flanges formed by folding a sheet metal blank relative to the side flanges, and one or more load-transferring corner tabs extending inwardly from one or both of the top and bottom ends of one or more of the side flanges, each of the one or more load-transferring corner tabs having upper and lower surfaces, one of the upper and lower surfaces of each of the one or more load-transferring corner tabs overlapping and attached to one of the top and bottom surfaces of one of the top and bottom flanges thereby forming a double-folded corner configuration, the main panel and the side, top, bottom, and stiffening flanges formed by folding the sheet metal blank, the side flanges of a first wall section of said two or more wall sections for attachment to the side flanges of a second one of said two or more wall sections, the wall section assembly forming part of and being capable of carrying the loads of a building structure designed for human habitability.

* * * * *